US008579027B2

(12) United States Patent
Abdelmalek et al.

(10) Patent No.: US 8,579,027 B2
(45) **Date of Patent: *Nov. 12, 2013**

(54) MULTI-FUNCTIONAL COMPLETION TOOL

(75) Inventors: Adel Ghobrial Abdelmalek, New Orleans, LA (US); S Keith Fry, Raceland, LA (US); Lance C Fry, Raceland, LA (US)

(73) Assignee: Downhole & Design International Corp., Houma, LA (US)

( * ) Notice: Subject to any disclaimer, the term of this patent is extended or adjusted under 35 U.S.C. 154(b) by 344 days.

This patent is subject to a terminal disclaimer.

(21) Appl. No.: 12/766,896

(22) Filed: Apr. 25, 2010

(65) Prior Publication Data

US 2010/0200225 A1 Aug. 12, 2010

Related U.S. Application Data

(63) Continuation-in-part of application No. 11/933,242, filed on Oct. 31, 2007, now Pat. No. 7,730,944.

(51) Int. Cl.
*E21B 49/00* (2006.01)

(52) U.S. Cl.
USPC ..... 166/250.17; 166/332.4

(58) Field of Classification Search
USPC ..... 166/250.17, 332.4, 332.6, 313
See application file for complete search history.

(56) References Cited

U.S. PATENT DOCUMENTS

| | | | | |
|---|---|---|---|---|
| 5,484,022 | A * | 1/1996 | Coutts et al. | 166/336 |
| 7,377,321 | B2 * | 5/2008 | Rytlewski | 166/313 |
| 7,472,750 | B2 * | 1/2009 | Walker et al. | 166/278 |
| 7,730,944 | B2 * | 6/2010 | Abdelmalek et al. | 166/250.17 |

* cited by examiner

*Primary Examiner* — William P Neuder
(74) *Attorney, Agent, or Firm* — Ahab Ayoub

(57) ABSTRACT

A multi-functional completion tool which may be lowered into a wellbore coupled to a length of tubing, and then utilized to test various lengths of the tubing at pressure. The tool may also function as a positive plug, may be used to set a packer, and is also useable as a tubing self-filling tool. Various retention elements are disposed within the tool and configured to release at predetermined pressures, or within predetermined ranges of pressure, thereby transforming the tool from a first configuration to a second configuration depending on the desired function. The tool may use a flapper mechanism to regulate passage of fluids through the housing, and a piston and/or flow tube may also be utilized to lock the flapper in an open or closed orientation within the housing.

3 Claims, 4 Drawing Sheets

MULTI-FUNCTIONAL COMPLETION TOOL

CROSS-REFERENCE TO RELATED APPLICATIONS

This application is a continuation-in-part of U.S. patent application Ser. No. 11/933,242, filed Oct. 31, 2007, and entitled "MULTI-FUNCTION COMPLETION TOOL," hereby incorporated by reference in its entirety.

BACKGROUND OF INVENTION

1. Field of the Invention

The present invention relates generally to a downhole oil and gas well completion tool which is operatively connectible to a lower section of tubing or a packer and configured to perform multiple completion-related functions.

2. Background Art

The harvesting of hydrocarbons from a subterranean formation involves the deployment of a drilling tool into the earth. The drilling tool is driven into the earth from a drilling rig to create a wellbore through which hydrocarbons are passed. Once a predetermined well depth is reached, the formation is tested to evaluate and determine whether the well will be completed for production, or plugged and abandoned.

Completion of a well generally refers to the operations that prepare a well bore for producing oil or gas from the reservoir. The goal of these operations is to optimize the flow of the reservoir fluids into the well bore, up through the producing string, and into the surface collection system.

The well bore is typically lined (cased) with steel pipe, and the annulus between well bore and casing is filled with cement. Properly designed and cemented casing prevents collapse of the well bore and protects fresh-water aquifers above the oil and gas reservoirs from becoming contaminated with oil and gas and the oil reservoir brine. Similarly, the oil and gas reservoir is prevented from becoming invaded by extraneous water from aquifers that were penetrated above or below the productive reservoir.

The nature of the reservoir, evaluated from a core analysis, cuttings, or logs, or from experience with similar productive formations, determines the type of completion to be used. In a barefoot completion, the casing is set just above the producing formation, and the latter is drilled out and produced with no pipe set across it. Such a completion can be used for hard rock formations which are not friable and will not slough, and when there are no opportunities for producing from another, lower reservoir. Set-through and perforated completions are also employed for relatively well-consolidated formations from which the potential for sand production is small. However, the perforated completion is used when a long producing interval must be prevented from collapse, when multiple intervals are to be completed in the one borehole, or when intervening water sands within the oil-producing interval are to be shut off and the oil-saturated intervals selectively perforated.

A string of steel tubing is lowered into the casing string and serves as the conduit for the produced fluids. The tubing may be hung from the well-head or supported by a packer set above the producing zone. The packer is used when it is desirable to isolate the casing string from the produced fluids because of the latter's pressure, temperature, or corrosivity, or when such isolation may improve production characteristics. The string, which may be referred to herein as a tubing string, may comprise any number of components known in the art. Such components, in addition to tubulars, may include tools, joints, packers, etc.

To complete the well, casing is installed and cemented in the wellbore, then production tubing is installed in the casing, which is perforated so that hydrocarbons may pass from the formation into the wellbore, and up to the tubing string to the surface for collection. Often a series of tests are conducted as a part of this process, to confirm the integrity of the casing and tubing.

When carrying out testing or other operations in a wellbore, test equipment or other apparatus may be mounted on an end portion of a string of tubular sections, known as tubulars to form a tubing string. The equipment is lowered into the bore on the end of the string, the length of the string being increased by the addition of further tubulars, which are threaded together to define a continuous internal bore between the apparatus and the surface.

A number of traditional methods exist for testing completion of a well and tubing. The most commonly used method involves the use of a wire-line retrievable plug. This process typically involves the hiring of a wire-line contractor to both run and pull the plug. The overall process is time-consuming, typically taking about 3-4 hours to set up the wire-line unit, and lower and set the plug by the wire-line. After setting the hydraulic packer and testing the completion and tubing, the wire-line operator will run the wire-line into the tubing again to retrieve the plug which might consume another 3-4 hours if no delays are encountered. Debris and impurities in the completion fluid and/or pressure trapped around the plug often result in sticking of the plug in the well. Retrieving a stuck plug can greatly increase the length of the process and may also lead to a loss of wire-line in the well, which will require the hiring of additional specialists to perform a fishing operation.

The use of the above-mentioned wire-line operation is typically feasible only if the well deviation is no greater than 70 degrees. If the testing location where the plug will need to be set is at a greater deviation, the wire-line method may not be practical and the operator must use another method of running the plug such as coiled tubing. A coiled tubing operation, once on location, takes about 5 hours to set up. Once all of the equipment is set up, running the plug by means of the coiled tubing can easily take at least 4 hours, depending on depth. The coiled tubing operation may easily cost tens of thousands of dollars in addition to the total time used to run and retrieve the plug which may exceed 10 hours, if no problems are encountered.

A more recently developed method for setting a hydraulic packer and testing the completion and tubing involves the use of a glass disc which is run inside a special pipe attached to the bottom of the tubing string. When using the glass disc method, the tubing cannot be self filled, which will require that the completions operator either manually fill the tubing via a water hose from the surface, requiring significant time, or the operator will need to add another piece of equipment to the tubing string known as a self-filling tool.

After setting the packer and testing the tubing the completions operator needs to break the glass disc in order to have the tubing opened and ready for production. If the well is not highly deviated, the wire line contractor can set up his equipment and run into the well with his tool string and break the glass disc. This operation will take around 4-5 hours.

If the well is highly deviated (more than 70 degrees) then the completions operator may need to use a coil tubing contractor to break the glass disc. Also this operation will take around 5 to 6 hours in addition to the coil tubing set up/rental cost.

Another method of setting the packer and testing the tubing is to use a pump out plug which is a special short pipe with a ball seat fixed in a seat with a number of shear screws. After running the tubing completely, a ball is dropped from the surface. It takes around 40-60 minutes until the ball seats on the ball seat, then surface pressure is applied against the ball to set the packer and test the tubing. After testing the tubing the surface pressure is increased to shear the ball seat shear screws and pump the seat and the ball down into the well bottom. This method holds pressure from above only and can not hold pressure from below. For this reason another plug/barrier is needed to be run at the bottom of the tubing while dismantling the rig blow out preventor (BOP) and mounting the Christmas tree. Also some problems can happen when shearing the shear screws of the pump out plug due to completion fluid pressure differential across the ball, that leads to inaccurate shear value (either more or less than the predetermined pressure for shearing).

Accordingly, a need exists for a tool capable of performing various completion-related operations without requiring repeated pulling of the tool, or hiring of one or more specialists.

SUMMARY OF INVENTION

A downhole tool is disclosed that comprises a housing having a flapper disposed therein, a seat for reversibly mating with the flapper, a piston and a spring-loaded flow tube, collectively configured to provide multiple capabilities when used with a tubing string. Such capabilities may include, but are not limited to, self-filling of the string, testing of the string at one or more pressures, and formation of a positive plug. Once various operations are completed, the flapper may be locked in an open orientation, thereby allowing relatively unrestricted flow through the tool when the well is in production mode.

A method for testing a tubing string is disclosed, including the provision of a multi-functional testing tool, operative connection of the tool to a tubing string, lowering of the tool to a first test depth at which a first test is conducted, and then depending upon one or more parameters, the tool may be used for testing at a second depth, for formation of a positive plug, and/or configured to allow flow through a well.

A method for manufacturing a downhole tool is disclosed, including disposing a flapper within a housing, the flapper being configured to reversibly seal a passage through the housing, disposing a piston within the housing, and disposing a spring-loaded flow tube within the housing. Retention elements are used to operatively connect various elements to and within the housing, and configured to fail at predetermined pressures.

Other aspects and advantages of the invention will be apparent from the following description and the appended claims.

DETAILED DESCRIPTION

Figure 1:
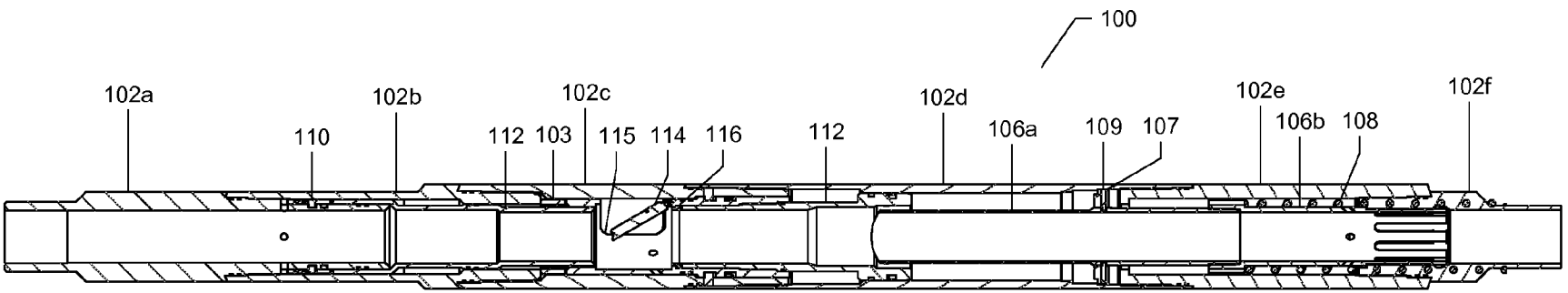
FIG. 1 shows one embodiment of the invention in a running (floating) configuration.

As shown in FIG. 1, one embodiment of the invention comprises a downhole tool 100 configured to perform multiple completion-related tasks, which may include, but are not limited to, self-filling of tubing, setting of a packer, testing of the tubing, testing of the annulus, and/or formation of a positive plug. The tool 100 comprises a housing 102. The housing 102 may be formed as a single unitary structure, or may include any number of sub-housings. In the embodiment of FIG. 1, the housing 102 comprises multiple operatively-connected sub-housings 102*a*, 102*b*, 102*c*, 102*d*, 102*e*, 102*f*. The housing 102 will typically have a cylindrical shape, although any other shape capable of passing through a wellbore may also be used.

An upper end of the housing 102 (or the sub-housing 102*a*) is configured to connect to a tubular or other component of a string leading to a surface location. Such configuration may include threads, shoulders and/or any other components known in the art to exist in the interface between two adjoining components of a tubing string. Alternatively, the housing 102 may be configured to connect to a capillary string and/or to be insertible into (and capable of passing through) one or more tubulars or other components of a string.

While the tool 100 will typically be disposed at a lower end of a string, and often may comprise the lower-most component of the string, the tool 100 may be disposed anywhere along the string. Accordingly, embodiments of the tool 100 may also be threaded or otherwise configured at a lower end to connect to other components of the string. In the embodiment of FIG. 1, the lower end of the tool 100 is configured as a wireline re-entry guide (mule shoe).

As used herein, the terms "lower," "bottom," or "bottom sub" refer to that section or end of the tool 100 which will be oriented closer to the end of the string (or nearer the bottomhole), while the terms "upper," "top," or "top sub" refer to that section or end of the tool 100 which will be located closer to that portion of the string leading to a surface location. Thus, in a vertical wellbore, the "top" or "top sub" section of the tool 100 will be above the "bottom" or "bottom sub" section of the tool 100 when the tool 100 is operatively connected to a string suspended in the wellbore. Similarly, the terms "upper" and "lower" refer to relative locations as determined within a vertical wellbore.

A number of components are disposed within the housing 102, including a piston 112, a flapper 114, a flapper housing 115, and a flapper seat 116. The flapper 114 is hingeably connected within the flapper housing 115, such that the flapper 114 may pivot between a first orientation and a second orientation. The operative connection between flapper 114 and flapper housing 115 may comprise a hinge or similar configuration.

In one embodiment, the operative connection between flapper 114 and flapper housing 115 comprises a spring-loaded pin operatively connecting the flapper 114 and flapper housing 115, forming an axis-of rotation about which the operatively-connected side of the flapper 114 will pivot. Such an embodiment advantageously biases the flapper 114 to a selected orientation, while permitting the flapper 114 to pivot to a second orientation. Any other mechanism known in the art may be used to bias the flapper 114 to a desired orientation. In one embodiment, the flapper 114 will be biased to abut the flapper seat 116, thereby restricting the passage of fluids or other materials through the flapper housing 115 (i.e., the flapper 114 is "closed").

In one embodiment, the flapper seat 116 comprises a lip configured to mate with periphery of the flapper 114, when the two are adjacent. A sealing material (e.g., rubber, plastic, Teflon, etc.) may be operatively connected to the flapper and/or flapper seat 116, thereby forming a soft seat which advantageously results in a more effective seal between the lip of the flapper seat 116 and the flapper 114. Alternatively, the flapper 114 and/or flapper seat 116 may be used without an operatively connected interface material, instead forming a metal to metal seal. While the flapper 114 and the mating lip of the flapper seat 116 will typically have a circular configuration to advantageously provide minimal interference with the passage of fluids through the housing 102 when the flapper 114 is open, the two may have any desired configuration, so long as they are compatible to substantially restrict flow through the housing when the flapper 114 is in a closed configuration.

Additionally, while embodiments of the operative connection between the flapper 114 and housing 102 may comprise a hinge or other pivoting mechanism, the flapper 114 may also be slideably disposed within the housing 102 or otherwise configured, so long as it is capable of being opened and closed in accordance with the various uses and mechanisms described in further detail herein. Furthermore, the flapper 114 and/or flapper seat 116 may also comprise a resilient material such as an elastomer, to advantageously provide a more secure mating relationship with the flapper seat 116.

As used herein, the term "retention element" means any element configured to retain a component in a desired position or range of movement under predetermined conditions. Embodiments of retention elements may be configured to release an operatively connected component under predetermined conditions. Such releasable retention elements may include, but are not limited to, shear screws, shear pins, ball-and-socket configurations, and any other elements capable of performing similar functions. Alternatively, other embodiments of retention elements may be fixed, and configured to permanently retain an operatively connected component within a predetermined location or range under normal use of the tool 100, e.g, an internal shoulder 107 of the flow tube 106*b*. Releasable retention elements typically maintain a desired relative orientation of operatively connected components under a first set of conditions (e.g., within a certain hydraulic pressure range) and release under a second set of conditions (e.g., beyond a certain hydraulic pressure range).

In various embodiments, retention elements may be positioned/configured to allow a certain movement, or relative freedom of movement, until certain conditions are met. For example, a retention element may lock into a position under specific conditions, thereby fixing an operatively connected component in space relative to a second component which is configured to receive and/or interact with a portion of the retention element under specific conditions. As will be described in detail below, the ratchet nut 103 of FIG. 1 is an example of such a retention element. While the embodiment of FIG. 1 shows the ratchet nut 103 operatively connected to one or more components of the housing 102 and configured to selectively mate with a configuration of a piston 112, other embodiments may include, e.g., a ratchet nut 103 or similar configuration operatively connected to the piston 112 and configured to selectively mate with one or more mating elements operatively connected within the housing 102.

In one embodiment, the piston 112 is moveably disposed within the housing 102 and secured in a first position by one or more retention elements 110. A flow tube 106 is disposed within the housing 102, below the piston 112. While the flow tube 106 may comprise an integral unit, in the embodiment of FIG. 1, the flow tube 106 comprises an upper flow tube 106*a* and lower flow tube 106*b*.

A spring 108 is disposed within the housing 102, operatively connected between the flow tube 106 and bottom sub 102*f*. In one embodiment, the spring 108 is retained in a compressed configuration between an internal shoulder 107 formed in the lower flow tube 106*b*, and an upper end of the bottom sub 102*f*. A shear ring 109, comprising a plurality of retention elements (e.g., shear screws), operatively connecting the flow tube 106 (typically the upper flow tube 106*a*) and housing 102, maintains the flow tube 106 in a first position within the housing 102, against the bias of the spring 108.

In the running configuration of FIG. 1, the flapper 114 is open (i.e., not abutting the flapper seat 116 to form a seal), and passage of fluid through the tool 100 is possible. As the device is run into a wellbore, upward force exerted on the flapper 114 from beneath the tool 100, opens and/or maintains the flapper 114 in an open orientation, permitting fluid to flow into the bottom of the housing 102, past the flapper 114, and into the tubing above the tool 100, thereby permitting passage of fluid from a location below the tool 100, into the tubing above the tool 100. Such a configuration advantageously allows for the filling of tubing above the tool 100 without the need for manual filling from the surface, or the addition of additional fill tools. Such a configuration also advantageously facilitates the downward movement of the tool 100, and operatively connected tubing, through the wellbore with decreased resistance from the fluid beneath, which is able to pass through the tool 100.

The force exerted on the flapper 114 from beneath typically comprises a fluid bottom-hole pressure acting in an upward direction as the tool 100 is moved downward through the wellbore. This "buoyancy force" is generated by the well's fluid hydrostatic head pressure. As the tool 100 is lowered into a wellbore, the buoyancy force acts upon the lower surface(s) of the flapper 114.

Figure 2:
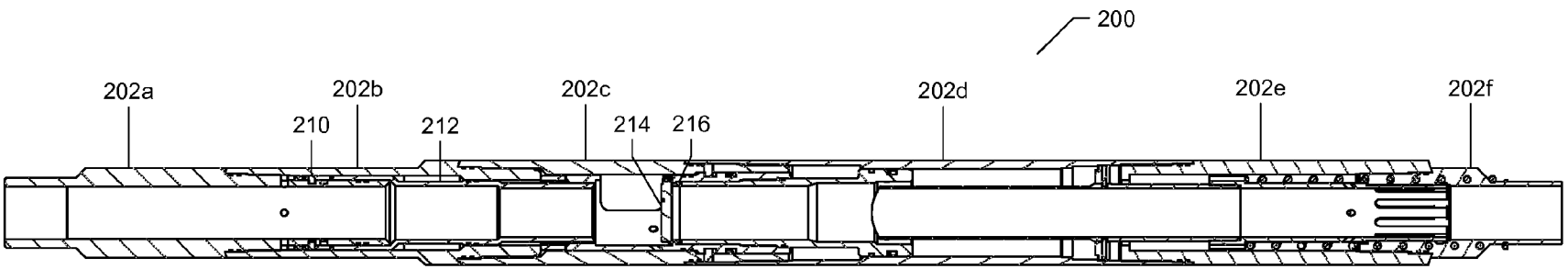
FIG. 2 shows one embodiment of the invention in a repetitive testing configuration.

Once a first test depth is reached in a wellbore, running of the tool 100 is discontinued, and surface pressure is increased in the tubing above the tool 100 to a pressure sufficient to overcome any buoyancy force acting on the flapper 114 from beneath, thereby permitting the flapper 114 to close. Typically, the increase of surface pressure is achieved using a rig pump to increase pressure in the tubing, adding to the existing pressure exerted by the weight of the completion fluid above the tool 100. As shown in embodiment of FIG. 2, the tool 200 is now in a testing configuration. Increased pressure in the tubing above the tool 200 exerts a downward force on the flapper 214, maintaining a closed orientation of the flapper 214.

In the testing configuration, passage of fluid through the housing 202 is restricted by the seal formed between the flapper 214 and the flapper seat 216. This permits the testing of the tubing and/or other elements of the tubing string located above the tool 200 in the wellbore. Such testing may be performed by increasing and/or holding pressure in the tubing and evaluating whether the tubing and/or other elements of the string are able to hold pressure. An inability to maintain pressure in the tubing is often indicative of a lack of integrity of the tubing, the joints, and/or other elements of the string.

If a lack of integrity is indicated by the testing, the operator may bleed off remaining pressure in the tubing and then pull the tool 200 to a second testing depth within the wellbore, where pressure may once again be increased and an evaluation of the tubing initiated. In such a fashion, the tool 200 may be advantageously used to localize defects in the tubing string.

If integrity is confirmed by the testing at a selected test depth, additional tubulars may be added to increase the length of the tubing string, and the tool 200 run to a second test depth at which point pressure in the tubing is again increased, and string integrity is again tested. This operation may be repeated until a predetermined final depth is reached.

After reaching the final test depth, pressure in the tubing may be increased beyond a first threshold, to a pressure beyond the range utilized in preceding tests. This pressure range may encompass one or more pressures required to set one or more packers disposed within the wellbore.

String integrity may thus be tested at increased pressures until a pressure is reached that is sufficient to displace the piston 212 from its first position to a second, lower position, within the housing 202. This will typically occur due to the release or failure of retention elements such as shear screws 210 which operatively connect the piston 212 to the housing 202. The shear screws 210 will typically be configured to release or fail at a pressure above that of the initial testing ranges.

Figure 3:
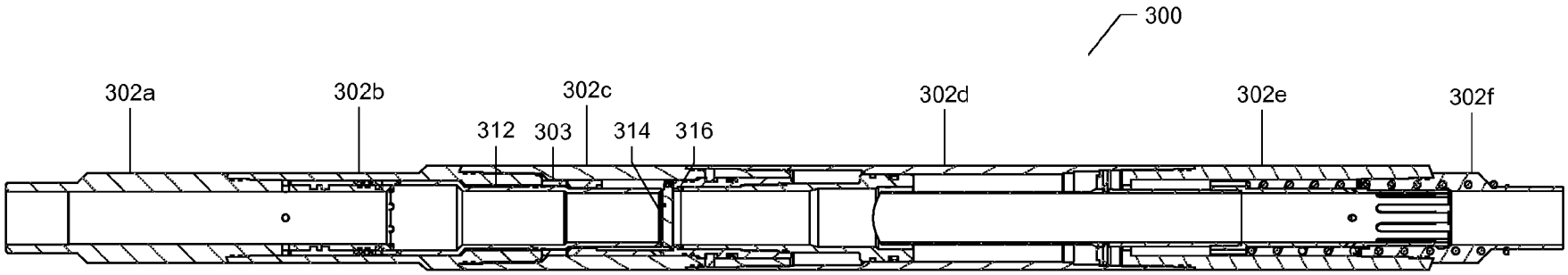
FIG. 3 shows one embodiment of the invention in a final testing configuration.

As shown in the embodiment of FIG. 3, the tool 300 is now in a plugging configuration. Threads, ridges, teeth, and/or similar topography on an outer surface of the piston 312 are configured to interact with the ratchet nut 303 (or similar directional retention element), as the piston 312 moves within the housing 302. This ratchet nut 303 is configured to be displaced when contacted by the threads of the piston 312 from a first direction, but not when contacted from a second direction. Thus, the ratchet nut 303 functions to restrict any reversal of the displacement of the piston 312, and also to maintain the piston 312 in a desired position or range. Alternatively, the ratchet nut 303 may be operatively connected to the piston 312, and the mating topography for the ratchet nut 303 may be disposed on an interior surface of the housing 302 or some component thereof, such that the two will interact as previously described. Any other mechanism which restricts a reversal of the movement of the piston 312 may be used instead of the ratchet nut 303.

With the flapper 314 locked in place by the piston 312, the tool 300 functions as a positive plug, holding pressure from both above and below. The flapper 314 is locked against the flapper seat 316. The positive plugging configuration provides a number of additional advantages, including but not limited to, the ability to test the tubing string at higher pressures than previously utilized, the ability to test the annulus, and, because pressure is held from below, the tool 300 may also function as a safety device during the disassembly of the BOP and assembly of the wellhead or christmas tree at the top of the well.

Figure 4:
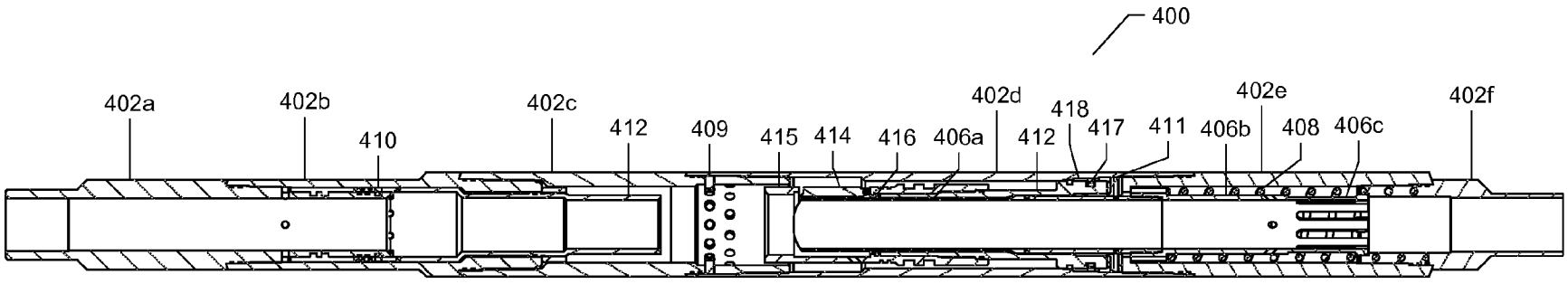
FIG. 4 shows one embodiment of the invention in a production configuration.

Once the christmas tree is assembled, it is typically desirable to begin production. Accordingly, as shown in the embodiment of FIG. 4, the tool 400 will be placed in a production configuration. To reach a production configuration, additional pressure is applied within the tubing, beyond the pressure range utilized to release the operative connection of the piston retention element(s) 410, and sufficient to cause a release of the flapper housing retention element(s) 409. Typically, the release of these retention elements 409 occurs as a result of increased pressure within the tubing pressing the piston 412 against the flapper 414, flapper housing 415, and/or flapper seat 416, with sufficient force to release the retention elements 409 which maintain the flapper housing 415 at a first location within the housing 402. This increased pressure will typically be in a range greater than any pressure range previously applied to achieve testing and/or positive plugging configurations of the tool 400. This increased pressure range may encompass one or more pressures required to set one or more packers within the wellbore.

Upon release of the retention element(s) 409 securing the flapper housing 415 in a first position, the flapper housing 415, including the flapper seat 416 and flapper 414 will be displaced downwardly through the housing 402 due to increased pressure in the tubing. As the flapper housing 415 moves through the tool housing 402, snap ring 417 operatively connected to an outer surface of the flapper housing 415 will enter a mating configuration with a mating recess 418 disposed in an interior surface of the housing 402 (or some sub-component thereof), fixing the flapper housing 415 in a second position within the tool housing 402. Other mechanisms capable of performing similar functions may be used in place of the snap ring 417/mating recess 418 combination.

As the flapper housing 415 is displaced from its first position to the second position, it will release the retention element(s) (e.g., shear ring 411) securing the flow tube 406. Upon release of these retention elements 411, the flow tube 406 will be displaced by the decompression of the spring 408, such that it moves upwardly through the flapper housing 415, opening the flapper 414, and/or maintaining the flapper 414 in an open orientation, between an outer surface of the flow tube 406 and an inner surface of the tool 402 (e.g., within the tool barrel 402*d*).

Decompression of the spring 408 causes the flow tube 406 to move upwardly within the tool housing 402 until a first mating element 406*c* (e.g., a collet), formed in, or operatively-connected to, an outer surface of the flow tube 406 enters a mating relationship with a second mating element (e.g., a recess) formed in, or operatively connected to, an inner surface of the housing 402 (or subcomponent thereof) such that the mating of the first mating element 406*c* and second mating element will secure the flow tube 406 in a second position within the housing 402. Locking of the flow tube 406 in the second position will maintain the flapper 414 in an open position, maintaining a substantially unrestricted passage through the tool 400, as will be advantageous in a production configuration. First and second mating elements may be of any type known in the art, and are not limited to a collet 406*c* and recess. Furthermore, other mechanisms capable of exerting a desired force or bias upon the flow tube 406 may be used in place of the spring 408.

In various embodiment, the tool may be configured to operate in only selected configurations selected from those previously described. For example, in one embodiment, the tool is configured to transition from a running configuration, capable of self-filling the tubing operatively connected above, to a positive plug, capable of holding pressure in the tubing both above and below the tool.

In one embodiment, the tool is configured to transition from a running self-filling configuration, to a positive plug, to a production configuration. In one embodiment, the tool is configured to transition between a running and a testing configuration, for repeated testing operations, and then to a positive plug. In one embodiment, the tool is configured to transition between a running and a testing configuration, for repeated testing operations, then to a positive plug, and finally to a testing configuration.

In one embodiment, the tool 400 may be configured without a piston 412, and pressure within the tubing will act directly upon the flapper 414 and/or flapper housing 415, causing the flapper housing retention elements 409 to release such that the flapper housing 415 will be displaced downwardly within the housing 402 until the flapper 414 and/or flapper housing 415 contacts a component within the tool housing 402 leading to the locking of the flapper 414 in an open orientation, as previously described. In one embodiment, the tool 400 is configured such that increased pressure within the tubing beyond a predetermined range will press the flapper 414 into the flapper housing 415 with sufficient force to shear the flapper housing retention elements, causing the flapper housing 415 to be displaced downwardly within the housing 402, thereby releasing the flow tube retention elements 411.

Embodiments of the downhole tool disclosed herein may be used at various pressure ranges and the retention elements may vary in type, configuration, quantity, and other characteristics as required to render the embodiments operative in the manner described at selected pressures or pressure ranges. One embodiment of the downhole tool may be configured to operate at different well formation working pressures. In one or more embodiments, operating pressure ranges may be selected based upon the make-up characteristics of a given well formation.

Release pressures (or pressure ranges) will typically be selected within the operating pressure range based on a number of factors. Such factors may include the predicted operating pressure within the wellbore, tubing/joint tolerances, and sufficient differentiation to ensure that desired operations may be performed between a first and second release pressure, without inadvertent release of additional retention elements.

The various components of embodiments of the tool described herein may be formed of any material or combination of materials known in the art. Furthermore, dimensions of the various components may vary from those depicted in the figures. Typically, embodiments configured to operate at higher pressure ranges will comprise more robust materials and have an increased wall thickness.

In one embodiment, representative release pressures of the retention elements which retain the piston may be 2000 psi, 2500 psi, 3000 psi, 3500 psi, and 4000 psi, respectively, which will typically correspond to a selected number of retention elements (e.g., shear pins). In such an embodiment, the number of shear pins correlating to the release pressures may be 4, 5, 6, 7, or 8 shear pins, respectively, to attain the selected release pressures, depending on the configuration of each shear pin. Similarly, in one embodiment, the flapper seat retention elements may release at 2500 psi, 3000 psi, 3500 psi, 4000 psi, and 4500 psi respectively. Again, these representative release pressures may correspond to the use of selected numbers of retention elements, such as 5, 10, 15, 20, or 25 retention elements, respectively, for the stated release pressures. As previously discussed, typical release values for the piston will typically be higher than those used to close the flapper and test the tubing, and typical release values for the flapper housing will typically be higher than those used to release the piston. Within this hierarchy of predetermined release pressures/ranges, embodiments may be configured to provide all of the various functions described herein within a predetermined pressure range, and the release pressures/ranges and associated types and/or configurations of retention elements may be selected accordingly.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A multi-functional downhole tool having an internal flapper system and capable of entering various operating modes based on pressure variations in an operatively-connected tubing string, the modes comprising:

a self-filling mode;

a testing mode;

a positive-plugging mode; and a production mode.

2. The multi-functional downhole tool of claim 1, configured to alternate between the self-filling mode and the testing mode, prior to entering the positive-plugging mode, the multi-function downhole tool actuatable by at least one selected from (a) mechanical actuation and (b) hydraulic actuation.

3. The multi-functional downhole tool of claim 1, configured to be one selected from (a) insertable into a tubing string, (b) operatively connectible to a tubing string, and (c) operatively connectible to a capillary string.

* * * * *